US007097072B2

(12) United States Patent
Tan et al.

(10) Patent No.: US 7,097,072 B2
(45) Date of Patent: Aug. 29, 2006

(54) CONTINUOUS-FLOW FLUID DISPENSER

(75) Inventors: Ah Beng Tan, Milpitas, CA (US); Peter H. M. Chang, Milpitas, CA (US)

(73) Assignee: Access Global, Inc., Milpitas, CA (US)

( * ) Notice: Subject to any disclaimer, the term of this patent is extended or adjusted under 35 U.S.C. 154(b) by 363 days.

(21) Appl. No.: 10/611,300

(22) Filed: Jul. 1, 2003

(65) Prior Publication Data

US 2005/0000984 A1 Jan. 6, 2005

(51) Int. Cl.
*B67D 5/08* (2006.01)

(52) U.S. Cl. ..... 222/67; 222/189.06

(58) Field of Classification Search ..... 222/67, 222/146.6, 189.06, 189.09
See application file for complete search history.

(56) References Cited

U.S. PATENT DOCUMENTS

| | | | | | |
|---|---|---|---|---|---|
| 2,772,817 | A | | 12/1956 | Jauch | |
| 3,572,553 | A | | 3/1971 | Ogden | |
| 4,792,059 | A | | 12/1988 | Kerner et al. | |
| 4,805,808 | A | | 2/1989 | Larson | |
| 4,881,661 | A | | 11/1989 | Jones | |
| 4,923,091 | A | | 5/1990 | Sutera | |
| 4,958,747 | A | * | 9/1990 | Sheets | 222/67 |
| 5,114,042 | A | | 5/1992 | Sutera | |
| 5,439,144 | A | | 8/1995 | Holzner | |
| 5,495,725 | A | * | 3/1996 | Middlemiss | 62/389 |
| 5,611,459 | A | | 3/1997 | Hinch | |
| 5,992,684 | A | * | 11/1999 | Russell | 222/1 |
| 6,007,710 | A | * | 12/1999 | Pavel | 210/90 |
| 6,056,154 | A | * | 5/2000 | Fowler | 222/1 |
| 6,155,460 | A | * | 12/2000 | Lee | 222/146.6 |
| 6,793,099 | B1 | * | 9/2004 | Sleiman | 222/67 |
| 2002/0170921 | A1 | | 11/2002 | Tan et al. | |
| 2003/0019764 | A1 | * | 1/2003 | Baldwin et al. | 205/742 |
| 2003/0183649 | A1 | * | 10/2003 | Tan et al. | 222/67 |

OTHER PUBLICATIONS

Product Advertisement of Ascent Product, Inc.
Product Advertisement of Waterworld USA, Inc.

* cited by examiner

*Primary Examiner*—Joseph A. Kaufman
(74) *Attorney, Agent, or Firm*—Kam T. Tam

(57) ABSTRACT

A drinking-fluid dispenser includes an uprightly oriented bottle having an open end and a close end. Mounted inside the bottle adjacent the open end is a valve connected to a float by an actuating arm. There is also a pressure-vent unit insertably disposed near the open end of the bottle for maintaining atmospheric pressure above the fluid inside the bottle. During normal use, fluid extracted out of the bottle is replendished by an external fluid source which is in fluid communication with the bottle through the valve. The valve in turn is controlled by the float which buoyantly floats on the fluid, closes and opens the valve, respectively, when the fluid rises and falls inside the bottle.

8 Claims, 8 Drawing Sheets

CONTINUOUS-FLOW FLUID DISPENSER

BACKGROUND OF THE INVENTION

1. Field of the Invention

The present invention relates to fluid storage and dispensing, and more particularly, to storage and dispensing of drinking fluid in fluid dispensers.

2. Description of the Related Art

Consumers prefer drinking purified water free of contaminants. Various products are available in the market to satisfy this demand. Bottled-water coolers are common and popular in offices or homes to serve small groups of users. In a typical bottled-water cooler, a refillable bottle filled with purified water is invertedly placed atop a cooler station. The cooler station includes a tank reservoir having at least one spigot. The bottle and the tank reservoir are in fluid communication with each other. When an user turns on the spigot, water flows out of the tank reservoir which in turn withdraws water from the bottle. Bottled-water coolers as mentioned above have certain consumer appeals. Among other things, the aesthetic display of a bottle of crystal-clear water is a key attractive feature. The body of clear water inside the transparent bottle visually conveys the perception of cleanliness and freshness, thereby favorably influencing the user psychologically even before any water is consumed.

However, there are various inconveniences associated with such bottled-water coolers. First, when all the water inside the bottle is consumed, the bottle needs to be replaced. Replacing an empty bottle with a filled bottle is quite a strenuous task. More particularly, it requires a person with considerable physical strength to carry and place a filled bottle atop the base. A typical 5-gallon bottle (22.7 liters) filled with water weighs about 50 lbs. (22.7 Kg.). The person performing the replacement has to lift the bottle from the floor. Thereafter, the bottled has to be inverted. In addition, the inverted bottle needs to be accurately placed into the opening of water-cooler's station tank. Mispositioning the bottle onto the station tank can cause water spillage. Furthermore, injuries to the persons performing the replacement are frequent.

To alleviate the aforementioned problems, various schemes have been devised to ease the bottle loading process. One such scheme is to have the water bottle loaded at the base, rather than on the top, of the water-cooler station. A typical system is marketed by Ascent Product Co., of Downey, Calif. as Ascent Back Saver™ in which the water bottle is designed to be loaded below the reservoir tank. In the system of Ascent, the water bottle sits on a base tray inside a cabinet which in turn is located at the lower part of the cooler station. The cabinet has a door with a transparent window allowing the visible display of the bottled-water.

During bottle replacement, the cabinet window is opened. The base tray carrying the bottle is slid outwardly. Then, the consumed bottle is lifted. A new bottle filled with water is then placed onto the base tray. After proper hook-up of the various water conduits, the cabinet door is then closed and the reloaded water-cooler is ready to be used.

In the system of Ascent, there is no need to lift the heavy bottle filled with water during replacement. However, there is still the need for transporting the filled bottle which is heavy. Bottle replacements are frequent because a replacement is required each time water in a bottle is consumed. Furthermore, considerable steps are still needed to reconnect the filled bottle back to normal use. Such reconnection normally requires the service of a trained technician. A nontrained person with unclean hands performing the reconnection may contaminate the water. As such, bottle replacement is not normally performed by a regular user. Rather, a water distributor is called in advance. Thereafter, a trained delivery person delivers a new bottle of water and performs the replacement. Thus, replacing the empty bottle is quite inconvenient and time-consuming, not to mention the cost associated with delivery. Alternatively, bottles filled with water can be stored in advance. However, this option requires storage space. Still, it is necessary to have a trained person to perform the bottle replacement.

There is a need to provide a water cooler having the aesthetic advantages of a conventional bottled-water cooler yet without its associated inconveniences.

SUMMARY OF THE INVENTION

It is the object of the invention to provide a continuous-flow drinking-fluid dispenser with the drinking fluid visible to the users. It is another object of the invention to provide a continuous-flow drinking-fluid dispenser which is easy to install and maintain. The objective of providing such continuous-flow drinking-fluid dispenser with simplicity in design thereby improving overall operational reliability and curtailing manufacturing costs is also sought.

The drinking-fluid dispenser of the invention includes an uprightly oriented bottle which can be used in conjunction with a cooler station or as a stand-alone unit. The bottle has a body portion and a neck portion. The body and neck portions are connected together by a shoulder portion. The body portion is larger in dimension in comparison to the neck portion. There is also an open end and a close end at the neck portion and the body portion of the bottle, respectively.

Mounted inside the bottle near the open end is a valve which is connected to a float via an actuating arm. There is also a pressure-vent unit insertably disposed near the open end of the bottle for maintaining atmospheric pressure above the water inside the bottle during normal use. In operation, water can be withdrawn by the user either via a suction tube inserted through the open end or via a spigot installed at the close end. The consumed fluid is replenished from an external water source via the float-controlled valve. Specifically, the float floats buoyantly on the water inside the bottle. When the water level inside the bottle recedes, the float sinks with the receding water and opens the valve via the actuating arm to admit water from the external water source. Conversely, when the water level inside the bottle rises, the float floats upwardly with the rising water and closes the valve to prevent further water entry from the external water source.

As arranged, a drinking-water dispenser with continuous flow is available. There is no need to constantly replace water bottles, and maintenance of the water dispenser is significantly curtailed.

These and other features and advantages of the invention will be apparent to those skilled in the art from the following detained description, taken together with the accompanying drawings, in which like reference numerals refer to like parts.

DETAILED DESCRIPTION OF THE INVENTION

Figure 1:
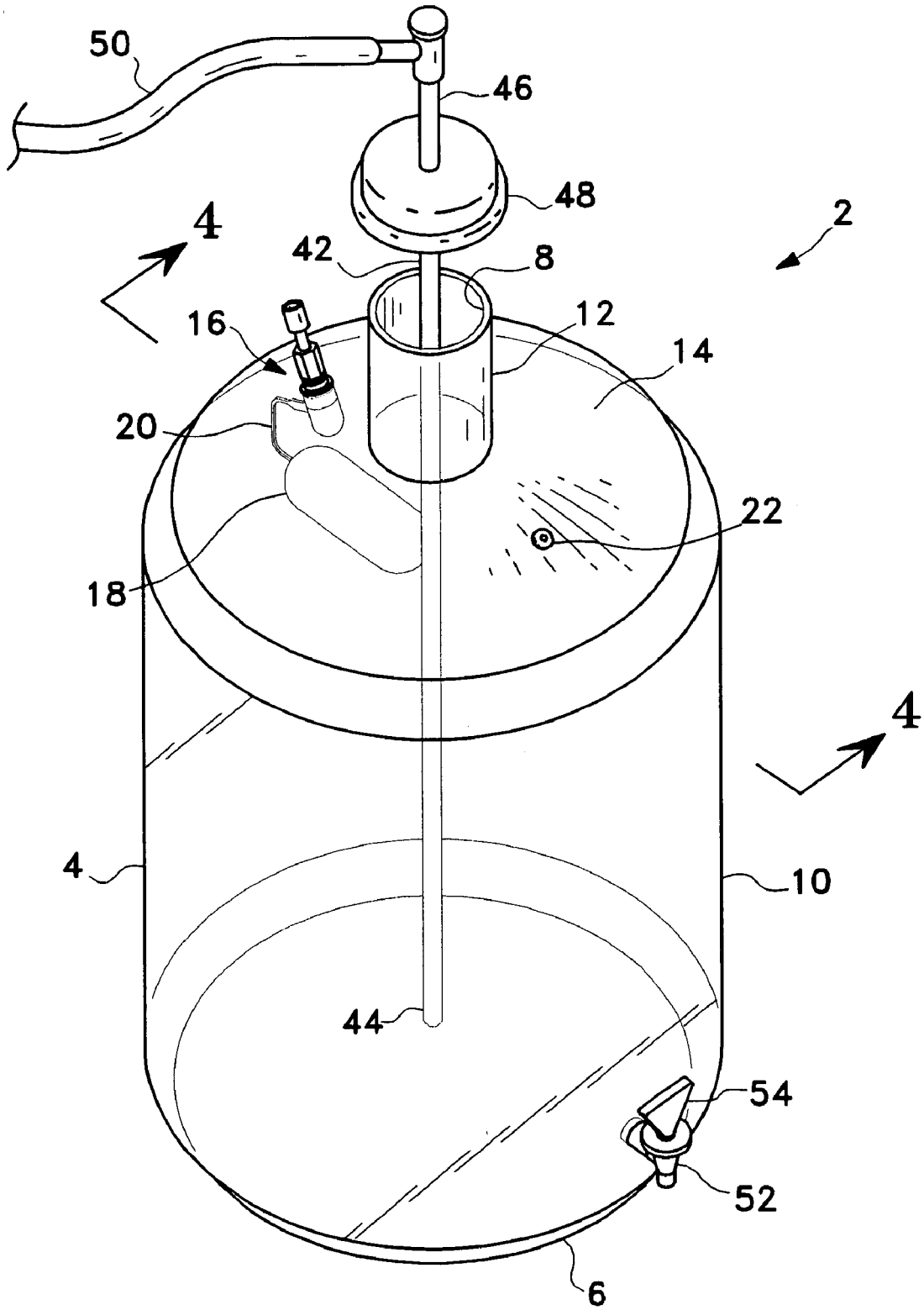
FIG. 1 is an perspective view showing the main components of the invention.

Reference is now directed to FIG. 1 which shows a perspective view, partially exploded, of the main components of the invention generally signified by the reference numeral 2. The assembly 2 includes a water bottle 4 having a close end 6 and an open end 8. The bottle 4 is preferably made of a transparent material such as clear plastic or glass. The bottle 4 generally is partitioned into three portions, namely, the body portion 10, the neck portion 12, and the shoulder portion 14. The neck portion 12 has a dimension smaller than the corresponding dimension of the body portion 10. The open end 8 is positioned at the neck portion 12 while the close end 6 is located at the body portion 10.

Disposed near the open end 8 of the bottle 4 is a fluid valve 16 which is actuated by a float 18 via an actuating arm 20. The fluid valve 16 may derive water from a continuous water supply source, such as the main water line (not shown in FIG. 1) of a building, for example. Preferably, water from the water supply source passes through a series of filters (not shown in FIG. 1) before entering the fluid valve 16. The purification process can be reverse osmosis, or carbon block filtration known in the art.

Figure 2:
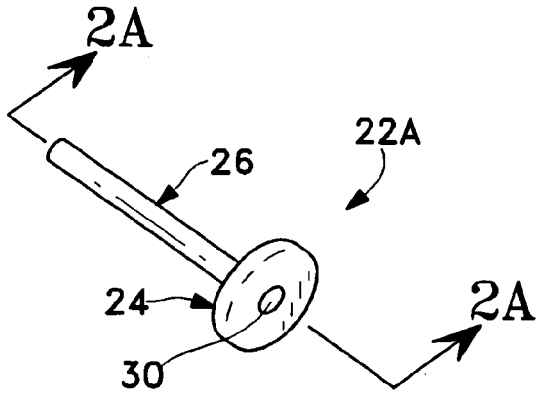
FIG. 2 is a perspective view of a pressure-vent unit used in accordance with the invention.
Figure 2A:
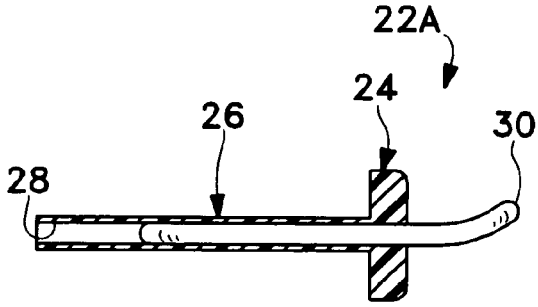
FIG. 2A is a cross-sectional view of the pressure-vent unit, taken along the line 2A—2A of FIG. 2.

Also positioned near the open end 8 of the bottle 4 on the bottle sidewall is a pressure-vent member 22. In accordance with the invention, the pressure-vent member 22 is designed to be insertable through the bottle wall. FIG. 2 is an enlarged perspective view of an exemplary pressure-vent member generally identified by the reference numeral 22A. FIG. 2A is a cross-sectional view taken along the line 2A—2A of FIG. 2. The pressure-vent member 22A has a flange portion 24 and a plug portion 26. In this case, the flange portion 24 is integrally formed with the plug portion 26. A cavity 28 is formed longitudinally through the hollow plug portion 26. Inserted into the cavity 28 is a filter 30. FIG. 2A shows the filter 30 being partially inserted into the cavity 28 of the hollow plug 26. The filter 30 is put in place for screening bacteria from entering into the water during use. The material for the filter 30 is preferably made of a porous material such as prolypropylene, cotton or yarn.

Figure 3:
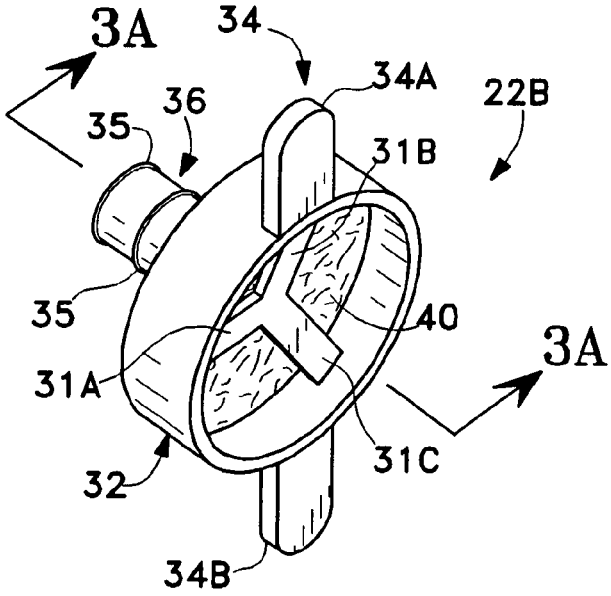
FIG. 3 is a perspective view of another pressure-vent unit used in accordance with the invention.
Figure 3A:
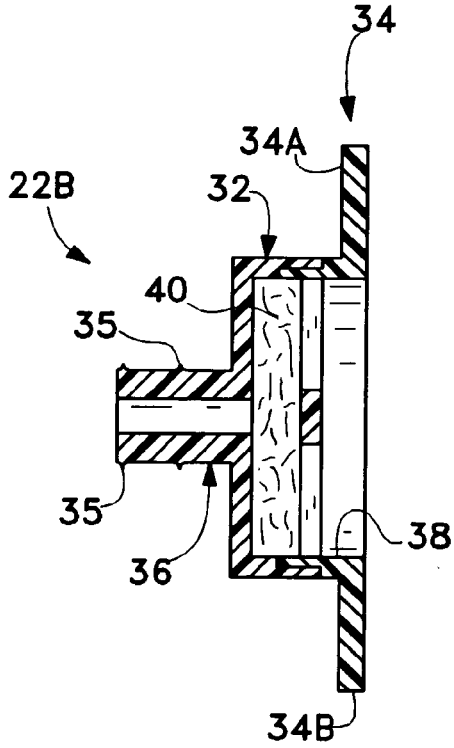
FIG. 3A is a cross-sectional view of the pressure-vent unit, taken along the line 3A—3A of FIG. 3.

Alternatively, the pressure-vent unit 22 can assume another form such as the pressure-vent member 22B shown in FIGS. 3 and 3A. FIG. 3 is an enlarged perspective view of the pressure-vent member 22B. FIG. 3A is a cross-sectional view taken along the line 3A—3A of FIG. 3. In the pressure-vent member 22B, there is a flange portion 34 connected to a hollow plug portion 36 via a chamber portion 32. The flange portion 34 has two flange pieces 34A and 34B. Again, there is also a cavity 38 which is formed in the chamber portion 32 through the plug portion 36 with decreasing dimension. In a similar manner, inserted into the cavity 38 is a filter 40. In this case, the filter 40 is relatively flat in comparison with the filter 30 in the pressure-vent unit 22A. FIG. 3A shows the filter 40 being inserted into the cavity 38 of the chamber portion 32. In the pressure-vent member 22B, the filter 40 is sandwiched between the plurality of filter retaining bars 31A–31C in the chamber portion 32 and the hollow plug portion 36. The flange portion 34 can be glued to, or simply snapped into, the chamber portion 32. The material for the filter 40 can be the same as the material used for the filter 30 in the pressure-vent member 22A shown in FIGS. 2 and 2A. During use, the plug portion 36 is inserted into the sidewall of the bottle 4. The plug portion 36 of the pressure-vent member 22B has a plurality of ridges 35 for reinforcing the retention with the sidewall of the bottle 4 when the pressure-vent member 22B is inserted.

Figure 4:
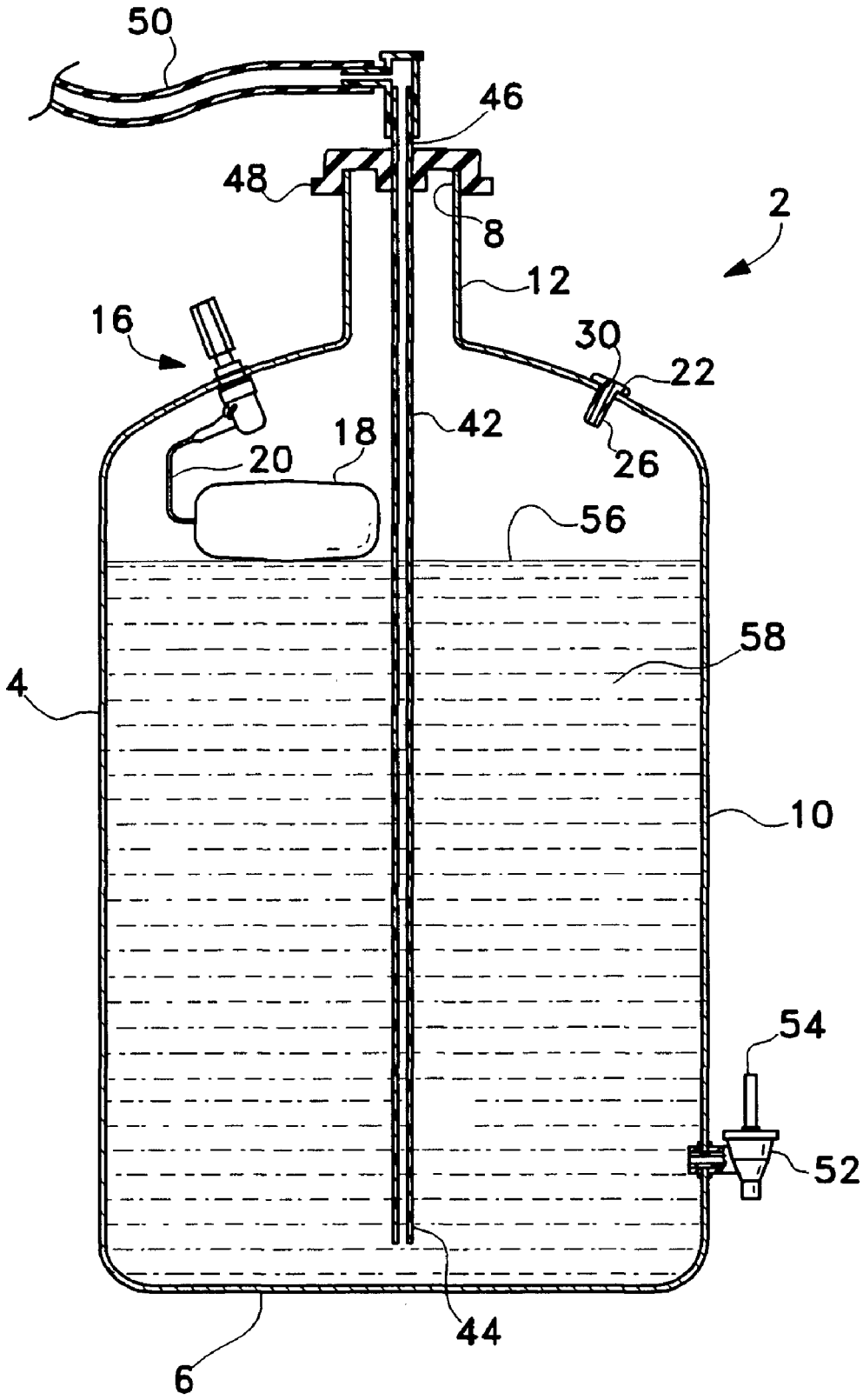
FIG. 4 is a cross-sectional view, taken along the line 4—4 of FIG. 1, showing the fluid-dispensing apparatus of the invention filled with fluid.

Reference is now directed to FIG. 1 in conjunction with FIG. 4. FIG. 1 shows no fluid in the fluid dispenser 2. However, in FIG. 4, which is a cross-sectional view taken along the line 4—4 of FIG. 2, it is shown that the fluid dispenser 2 is fully assembled and filled with fluid.

During use, water can be withdrawn from the bottle 4 in a variety of ways. For example, water can be withdrawn from a suction tube 42 that is insertable into the bottle 4 through the open end 8. The distal end 44 of the suction tube 42 is extended adjacent the close end 6 of the bottle 4. Near the proximal end 46 of the tube 42 is a closure cap 48 which closes the open end 8 of the bottle during use. The suction tube 42 is also configured to be in fluid communication with an external fluid conduit 50, which in turn is normally connected to a pump (not shown in FIGS. 1 and 4) for pumping water out of the bottle 4 when the fluid dispenser 2 in is use.

Alternatively, water can be withdrawn from the bottle 4 via a spigot 52 disposed adjacent the close end 6 of the bottle 4 as shown in FIGS. 1 and 4. In this case, the spigot 52 has a lever 54 which can be pressed for the opening or shutting off the water flow. Furthermore, no pump is needed since the fluid dispenser 2 is oriented in the non-inverted position, the gravitational force of water forces the water to flow out of the spigot 52 when the open position of the lever 54 is pressed.

During storage, transportation, or use, the bottle 4 is oriented in the non-inverted position. That is, the open end 8 is always positioned on the top of the close end 6. As such, the neck portion is preferably smaller in dimension in comparison to the body portion 10. A good design is to have an intermediate shoulder portion 14 which serves as a smooth transformation of the change of different dimensions. The shoulder portion 14 is ideal for the placement of the valve 16 and the air-vent member 22 so as to save lateral space and further for aesthetic considerations. Thus, as will be explained below, if water is withdrawn from the open end 8, a neck portion 12 with a smaller dimension facilitates water channeling. On the other hand, if water is withdrawn from the close end 6 via the spigot 52, a narrow neck portion 12 can be easily capped by the small cap member 48, thereby preventing spillage.

Figure 5A:
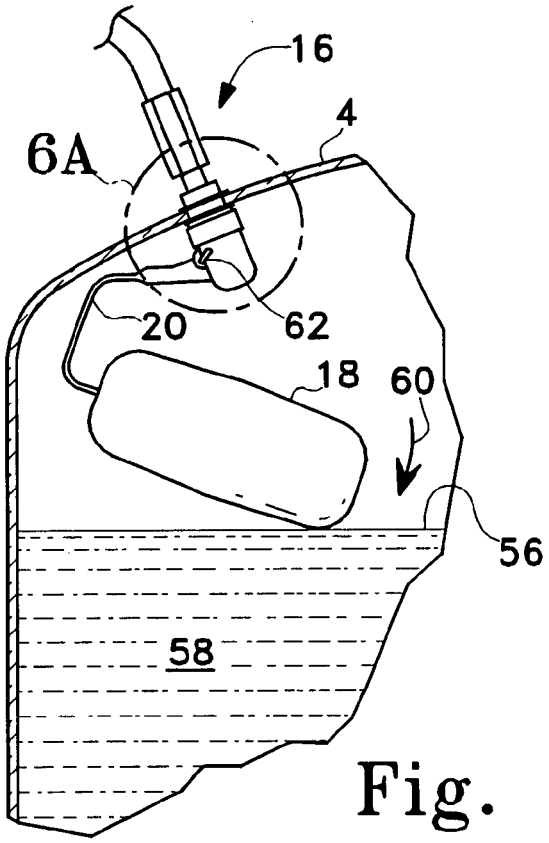
FIG. 5A is a fragmentary view, shown in cross-section, of the float actuating the valve when the fluid level recedes inside the bottle.
Figure 6A:
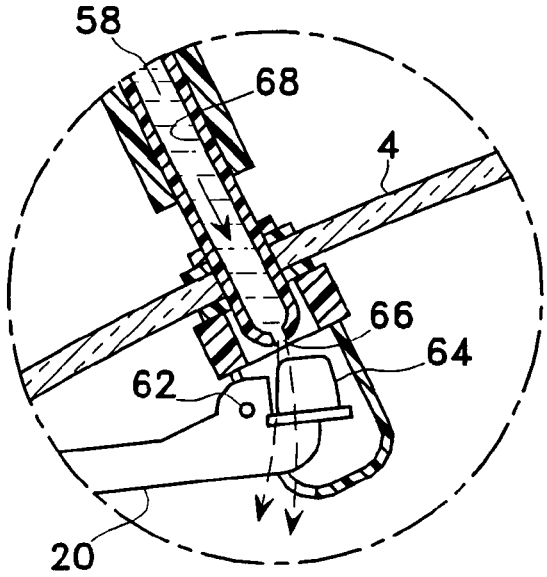
FIG. 6A is an inset view taken within the circle 6A of FIG. 5A.
Figure 5B:
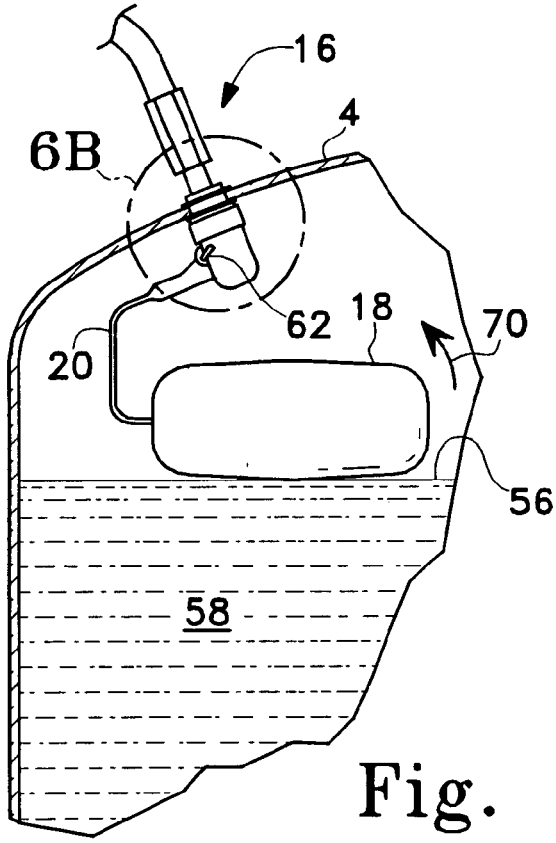
FIG. 5B is a fragmentary view, shown in cross-section, of the float actuating the valve when the fluid level rises inside the bottle.

The operation of the fluid dispenser 2 in accordance with the invention is herein described. During normal use, the bottle 4 maintains a predetermined fluid level 56 therein, as shown in FIG. 4. Reference is also directed to FIGS. 5A and 5B, in conjunction with FIG. 4. Suppose water, signified by the reference numeral 58, is withdrawn from the bottle 4, either via the suction tube 42 or the spigot 52. As a consequence, the water level 56 falls, as shown in FIG. 5A. Without the buoyancy support of the water 58, the float 18 drops due to its own weight. Accordingly, the float 18 rotates the actuating arm 20 in the direction 60 about the arm pivot 62, thereby withdrawing the piston 64 away from the opening 66 of the valve passageway 68, as shown in FIG. 6A. With no blockage of the piston 64, water 58 flows through the opening 66 from the valve passageway 68, and then into the bottle 4. The water 58 flowing into the passageway 68 is derived from a constant water supply source (not shown), such as the water line of a building.

Figure 6B:
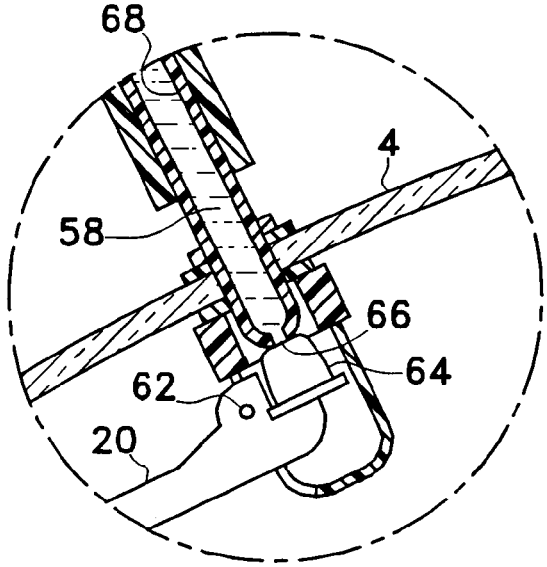
FIG. 6B is an inset view taken within the circle 6B of FIG. 5B.

While water 58 is filling the bottle 4 as described above, the buoyancy force of the rising water 58 pushes the float 18 against its gravitational force and rotates the actuating arm 20 in the other direction 70 about the arm pivot 62, as shown in FIGS. 5B. As a result, the piston 64 pushes against the opening 66 of the valve passageway 68, thereby preventing any water 58 from escaping from the passageway 68 as shown in FIG. 6B.

It also should be noted that for water 58 to freely flow in and out of the bottle 4, the air inside the bottle 4 below the open end 8 but above the water level 56 must maintain the ambient atmospheric pressure. The pressure-vent member 22 disposed adjacent the open end 8 of the bottle 4 performs this duty. In particular, when the water level 56 recedes, air is sucked into the bottle 4 through the filter 30 disposed in the hollow plug 26 of the pressure-vent unit 22 (FIG. 4), for example. On the other hand, when the water level 56 inside the bottle 4 rises, air is forced out of the bottle 4 through the filter 30 of the pressure-vent unit 22. As a result, the atmospheric pressure inside the bottle 4 above the water 58 is maintained.

The pressure-vent member 22 is designed to be insertably removable and replaceable. Depending on the surrounding environment and the frequency of use, after a period of prolonged use, the pressure-vent member 22 may need to be unplugged and replaced with a different unit 22 having a new filter 30 or 40. Changing of the air filter 30 or 40 thus reduces to a simple chore and requires no special skill of a trained technician. However, as an alternative, certainly only the filter 30 or 40 may be extracted and replaced, without discarding the entire air-vent unit 22.

It also should be noted that albeit with relatively simple design and with not many components, there is an efficient regulatory mechanism built in the valve 16. The piston 64 is made of resilient material, such as rubber or Teflon®. The actuating arm 20 is designed to be pivoted at a high leverage ratio. As such, the piston 64 can exert a strong force against the opening 66 of the valve passageway 68. For the sake of explanation, suppose there is water leakage from the opening 66. The leakage will accumulate water 58 inside the bottle 4, resulting in a higher water level 56 inside the bottle 4. Since the water 58 buoyantly pushes upwardly against the float 18 at the water level 56, the float 18 rotates the arm 20 further in the direction 70 (FIGS. 5B and 6B). As a consequence, the arm 20 pushes the piston 64 more tightly against the opening 66, thereby sealing the opening 66 from further fluid leakage.

In accordance with the invention, the valve 16 and the pressure-vent member 22 are positioned above the water level 56. Specifically, the key parts of the embodiment 2 occupy a relatively small volume of space above the water level 56. As is known in the art, the more extensive the components in physical sizes, the less reliable is the final mechanical assembly. Likewise, the more moving parts are installed and involved, the more likely is the final assembly prone to mechanical failure. In accordance with the invention, relatively few moving parts are used. Further, the moving parts are relatively small in geometry and are disposed above the fluid level 56, wherein the viscosity of the fluid impedes only minimally to the moving parts. Consequently, the movement of the parts can be responded with reliability and agility.

FIGS. 7A–7D shows an exemplary use of the invention. The embodiment of this invention is generally signified by the reference numeral 74 which includes a water-dispensing station 76. The station 76 can generally be partitioned into an upper portion 78 and a lower portion 80.

In the upper portion 78, there are two spigots 82 and 84 which in turn are connected to a tank reservoir tank 51 (FIG. 7C) inside the upper portion 78 of the station 76. An user can withdraw water from the spigots 82 and 84.

Figure 7A:
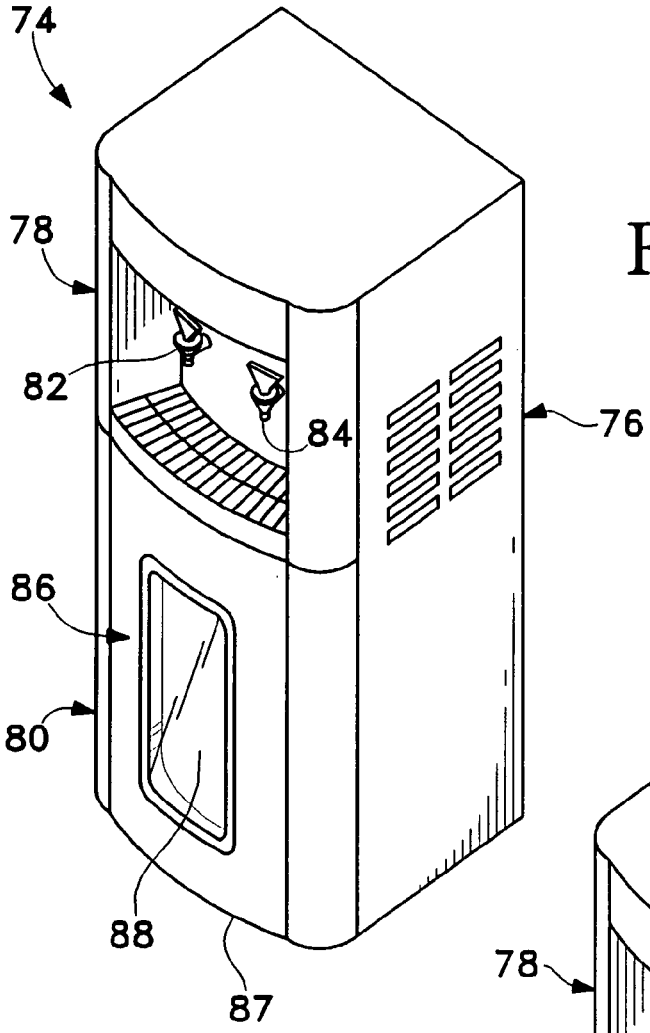
FIGS. 7A–7B show an exemplary use of the invention.
Figure 7B:
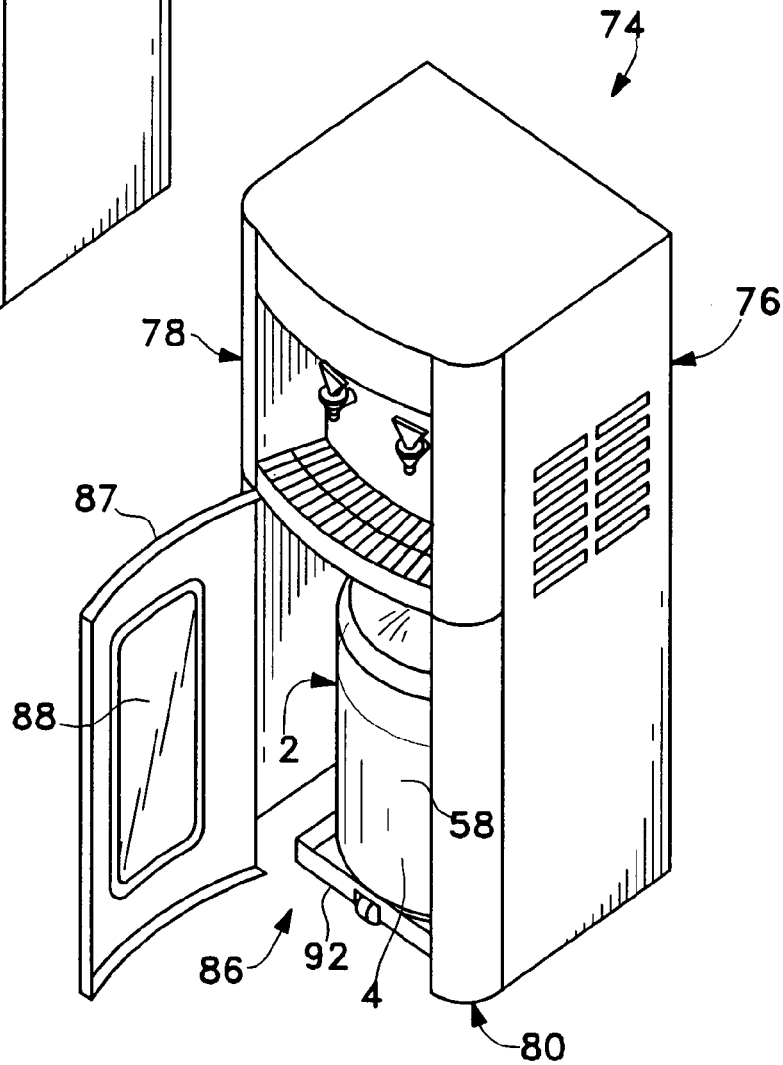
Figure 7D:
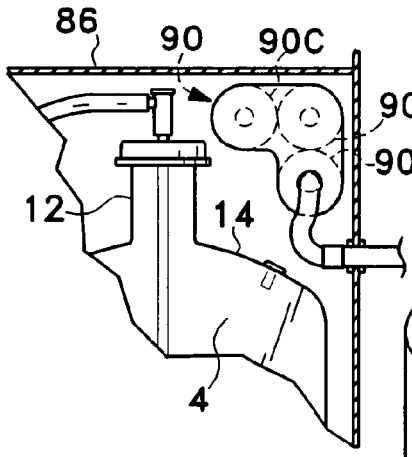
FIG. 7D is a fragmentary view, shown in cross-section, of the placement of filters in relation to the bottle of the exemplary use of the invention shown in FIGS. 7A–7C.

The lower portion 80 has a cabinet 86 which houses the water source. In this embodiment, the water source is the water bottle 4 filled with water 58, as shown in FIG. 7B. The bottle 4 and the tank reservoir 51 are in fluid communication with each other as will be further explained below. The cabinet 86 is protected by a cabinet door 87 which is hingedly attached to the lower portion 80. The door 87 has a window 88 preferably made of a transparent material, such as glass or Acrylic®. Thus, when the door 87 is closed, the bottle 4 can be visible through the window 88. If the bottle 4 is filled with water 58, the same aesthetic effect of viewing a bottle of crystal-clear water can also be achieved, in a manner similar to those water-coolers in which the bottled water is exposed and placed atop the station 76.

Since water 58 can continuously flow into the bottle 4, there is no need to constantly change the water bottle 4, as required by most prior art water-coolers. However, depending on the frequency of use and the surrounding environment, the entire station 76 including the bottle 4 may need periodic maintenance. During maintenance, water lines are checked for leaks and filters are replaced, for example. Change of filter for the water dispenser 2 is relatively straightforward. As explained above, all is needed is the unplugging of the used pressure-vent unit 22 (FIG. 7C) and replace it with a new counterpart.

Figure 7C:
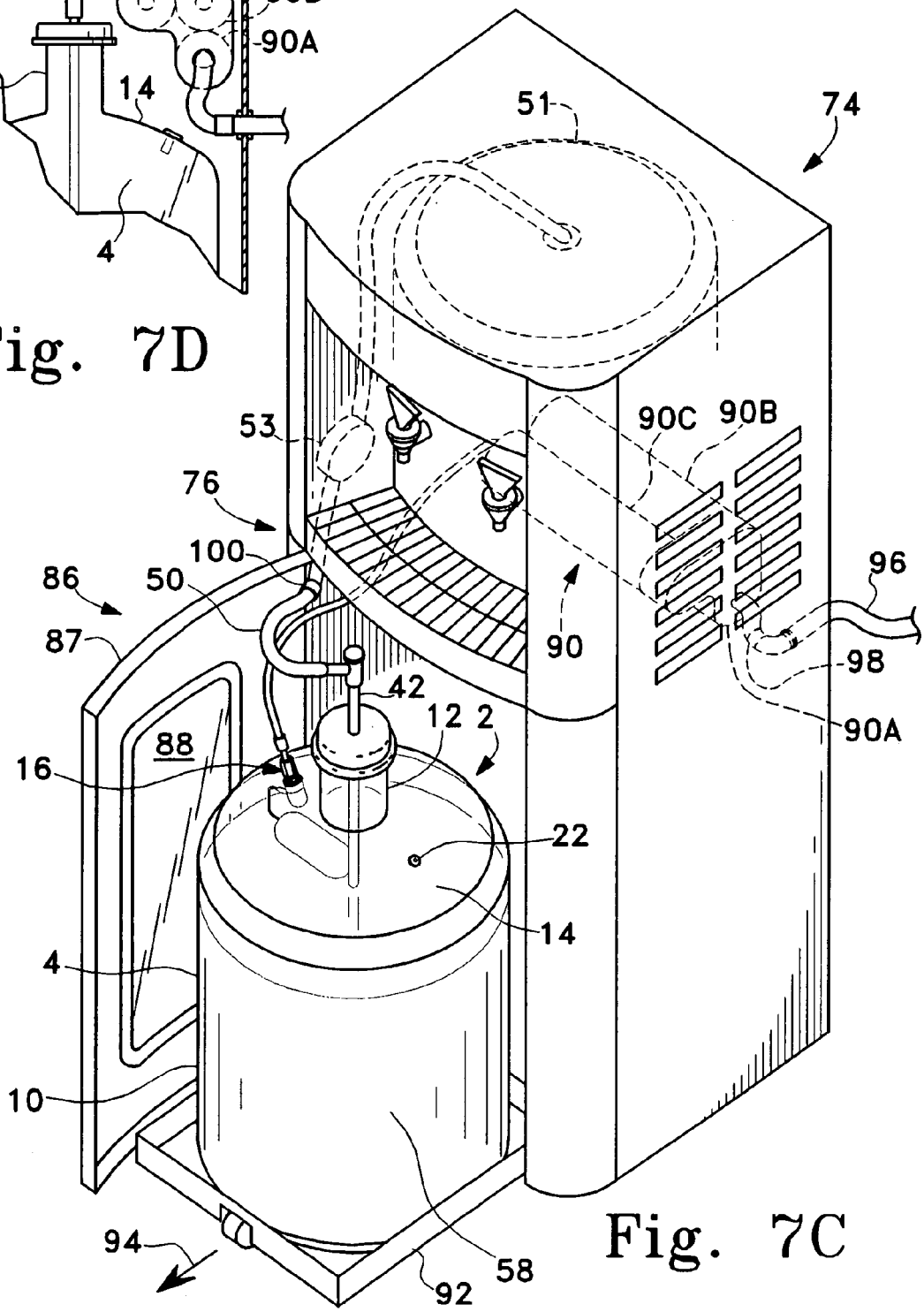
FIG. 7C shows the fluid flow of the exemplary use of the invention of FIGS. 7A–7B during maintenance.

Reference is now directed to FIG. 7C. If the water dispenser 2 along with the filters 90 need to be serviced or replaced, the door 87 of the cabinet 86 is first rotated open. The bottom tray 92 which carries the water container 2 is slid out of the lower portion 80 of the cabinet 86 in the direction 94 as shown in FIG. 7C.

In the following paragraphs, while describing the servicing of the water-cooler station 76, fluid flow in the various conduits and compartments of the station 76 and the bottle 4 is also explained at the same time.

Referring now to FIG. 7C, during normal use, water flows from a water source, such as the water line (not shown) of a building. The water then goes through an external conduit 96. Prior to entry to the fluid dispenser 2, water passing the conduit 96 goes through a series of filters 90A–90D. The filters, generally denoted by the reference numeral 90, is preferred to be the reverse-osmosis type known in the art. For example, the upstream filter 90A may contain fine charcoal powder which generally blocks away coarse particles such as sand or other debris. The midstream filter 90B may hold still finer charcoal powder which screens finer objects not visible to the naked eyes, such as bacteria or viruses. The downstream filter 90D carries a membrane, convolutedly folded, which filters away unwanted substance at the molecular level. The membrane enables the process of reverse osmosis to go through. Basically, the water pressure forces water through the membrane which allows only water molecules to pass through and blocks away molecules of larger sizes, such as chorine which is commonly added in most urban water systems.

After water leaves the downstream filter 90D, it enters into the bottle 4 through the valve 16 as previously described. In this embodiment, water 58 is extracted through the suction tube 42 into another external conduit 50. Water is then pumped into the tank reservoir 51 through a water pump 53 all located within the station 76.

Maintenance servicing is relatively simple. As describe above, once is the water dispenser 2 sitting on the tray 92 is slid out of the cabinet 86, what is needed is the loosening of two water-hose couplers. The first coupler, identified by the reference numeral 98, connects the external conduit 96 to the input of the upstream filter 90A. The second coupler, signified by the reference numeral 100, ties another external conduit 50 to the tank reservoir 51 via the pump 53 as illustrated in FIG. 7C.

Normally, the filters 90A–90D are bundled as one unit for ease of installation and removal. It also should be noted that with the neck portion 12 of the bottle smaller in dimension than the body portion 10, the filters 90A–90D fit well above the shoulder portion 14 when the fluid-dispensing assembly 2 is within the cabinet 86. Thus, space is optimally used as shown in the cross-sectional view of FIG. 7D. The filters 90A–90D are blocked from view when the door 87 is closed as shown in FIG. 7A.

Reference is now returned to FIG. 7C. Once the couplers 98 and 100 are loosened and detached, the filters 90A–90D as one entity along with the water bottle 4 can be removed and replaced with new counterparts. To put the station 76 back into service, the external conduit 50 is now connected back to the coupler 100. Likewise, the upstream filter 90A is also connected to the other external conduit 96 via the coupler 98. After the couplers 98 and 100 are tightened, the assembly 2 is then slid into the cabinet 86. The door 87 is then closed. Once water is filled into the bottle 4, the station 76 is back to normal use.

Figure 8:
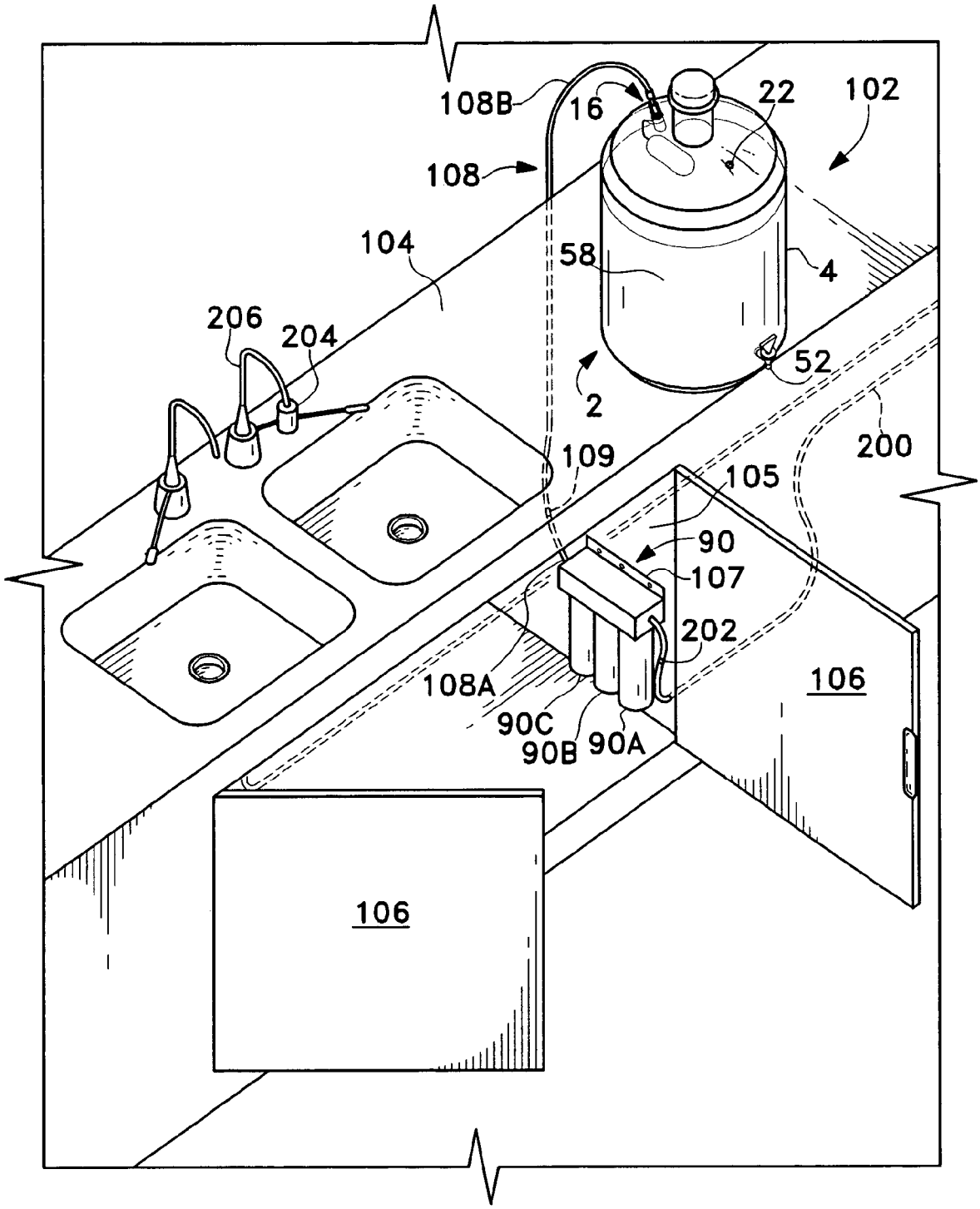
FIG. 8 is another exemplary use of the invention.

FIG. 8 shows another exemplary use of the invention. The embodiment of this invention is generally signified by the reference numeral 102 which is used as a stand-alone unit. In the arrangement 102, the water dispenser 2 is placed on the top of a water sink counter 104. The filter set 90 is placed under the counter 104 preferably covered by one or more hinged doors 106. As similarly described in the previous embodiment, the filters 90A–90D are bundled together as a filter set 90. The filter set 90 can be removably hooked onto a bracket 107 which in turn may be fixedly attached to the wall 105 of the counter 104, for example. The filter set 90 and the water dispenser 2 are connected via a conduit 108 which includes sections 108A and 108B. Connected between the sections 108A and 108B is a coupler 109. In this embodiment, water originates from a water line 200 which in turn is connected to the upstream filter 90A via a coupler 202.

Unlike the previous embodiment, there is no need to have a pump to carry the water upstream. Instead, the water pressure from the water line 200 forces water through the filer set 90 into the water bottle 4, controlled by the valve 16. During use, water is extracted from the bottle 4 via the spigot 52. The operation of this embodiment has been described and is not further repeated.

Maintenance again is relatively easy. The bottle 4 seldom needs to be replaced. However, the air filter 30 or 40 may need to be replaced periodically. As mentioned before, change of the filter 30 or 40 merely involves the unplugging of the pressure-vent unit 22 and replace it with a new counterpart.

For the change of the filter set 90, first the main water line 200 needs to be turned off. Then, the couplers 109 and 202 need to be loosened and discounted. Thereafter, the filter set 90 can be unhooked from the bracket 107. A new filter set 90 can be positioned back onto the bracket 107. After reconnecting the couplers 109 and 202, the water line 200 is turned back on. The entire dispenser 102 is then ready to return to normal use.

For usage including a small group of people, such as in a family or an office, some prior art filter heads, such as the head 204 connected to faucet 206 cannot provide truly purified water preferred for drinking. To begin with, the filter head 204 can only carry active charcoal filters without any reverse-osmosis filters, such as the filter 90D, shown in FIG. 8. As such, chemical molecules such as chorine or fluorine, or even small viruses, still exist after passing through the filter head 204. Using the water dispenser 102 in accordance with the invention, highly purified water can be available in which maintenance is relatively minimal. In addition, the aesthetic display of clear water 58 inside the bottle 4 is readily available.

Figure 9:
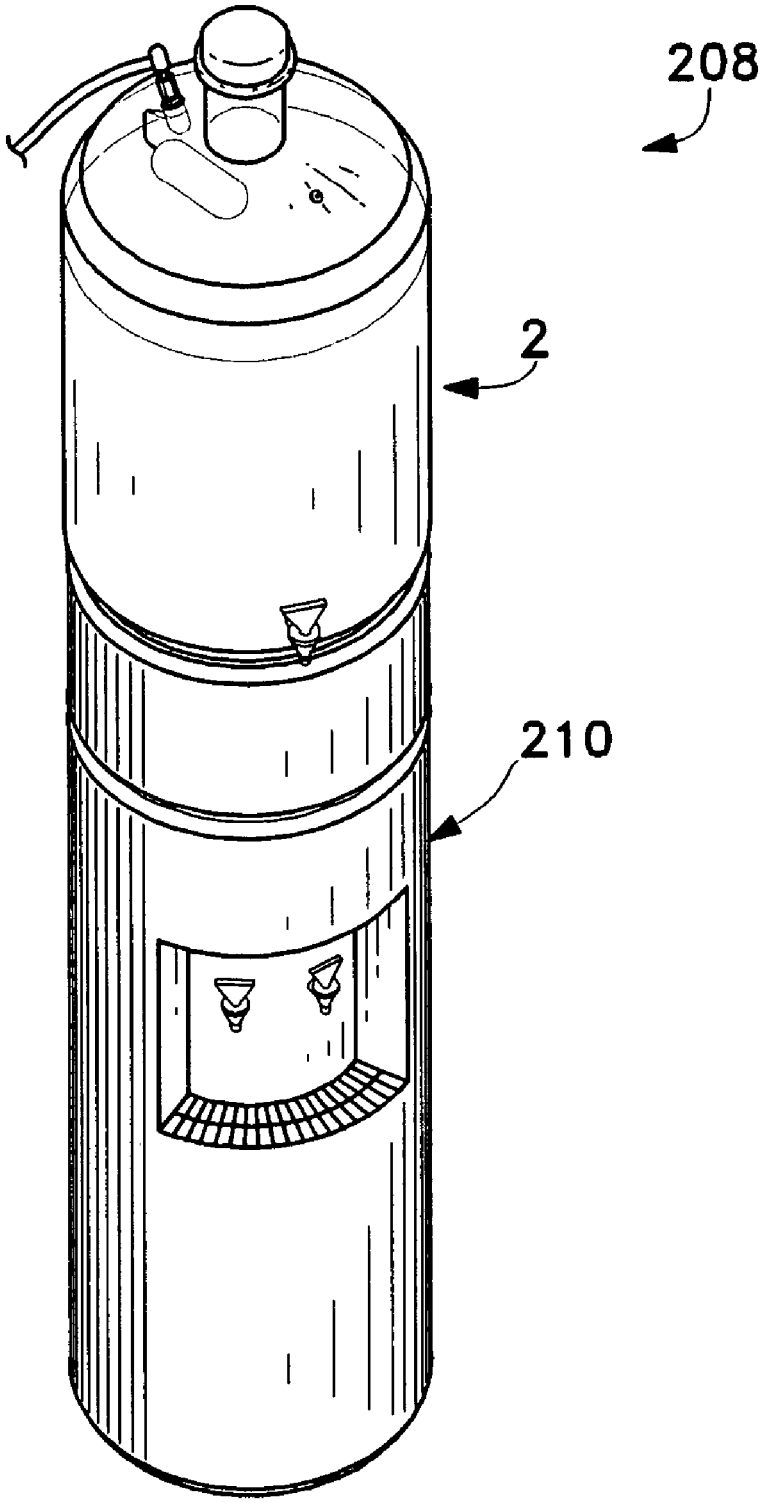
FIG. 9 is yet another exemplary use of the invention.

Finally, the embodiment described above includes many specificities, which should not be construed as limiting the scope of the invention but merely as illustration. Changes are possible within the scope of the invention. The fluid dispenser 2 can be used in different settings. For instance, shown in FIG. 9 is an arrangement in which the water dispenser 2 is placed on the top of a water-cooler station 210 which has a concealed water tank and does not have any bottle exposed. The placement of the water container 2 augmented the water carrying capacity of the station 210 and further allows the visual display of clear water to the user. Furthermore, for all the embodiments as described, the apparatus is depicted as used for dispensing drinking water. It is conceivable that the inventive apparatus can be used for dispensing other liquids, such as fruit juices, punches or sodas. In addition, the bottle 4 is described as made of a transparent material. A wide variety of materials can be chosen. For instance, it is possible to have translucent or even opaque bottles installed. It certainly is also feasible to have bottles etched or printed with various design patterns. Furthermore, the bottle can be inserted with multiple pressure-vent units 22, or an air-vent member with multiple venting holes insertable with multiple filters. It will be understood by those skilled in the art that these and other changes in form and detail may be made therein without departing from the scope and spirit of the invention.

What is claimed is:

1. A fluid dispenser for dispensing drinking fluid comprising:

a bottle having an open end and a close end;

a fluid valve disposed adjacent said open end and spaced from said close end, said fluid valve includes a float member connected thereto via an actuating arm; and a pressure-vent member removably disposed adjacent said open end and spaced from said close end, said presure-vent member having a cavity formed therethrough, said cavity being configured to receive filtering material, wherein during operation, said bottle maintains a predetermined fluid level therein, said bottle being made of a material whereby fluid in said bottle is visible through said bottle, said valve, float member and pressure-vent member being disposed above said fluid level, such that when fluid in said bottle reaches said fluid level, said float member buoyantly rises with said fluid thereby moving said actuating arm in one direction allowing said actuating arm to shut off said valve, and such that when fluid in said bottle falls below said fluid level, said float member buoyantly falls with said fluid thereby moving said actuating arm in another direction allowing said actuating arm to open said valve.

2. The fluid dispenser as in claim 1 further including an elongated tube member having a proximal end and a distal end, said elongated tube member being disposed in said bottle with said proximal and distal ends being respectively disposed adjacent said open and close ends of said bottle.

3. The fluid dispenser as in claim 2 further including a fluid-dispensing station having a cabinet portion, said bottle being disposed in said cabinet portion.

4. The fluid dispenser as in claim 3 further including a set of filters disposed in said cabinet, said set of filters being disposed adjacent said open end and spaced from said close end of said fluid bottle.

5. The fluid dispenser as in claim 1 further including a spigot disposed adjacent said close end and spaced from said open end of said bottle.

6. The fluid dispenser as in claim 5 further including a reverse-osmosis filter connected to said fluid valve via a fluid conduit.

7. The fluid dispenser as in claim 1 wherein said pressure-vent member further including a flange portion and a plug portion, said cavity being formed through said plug portion.

8. The fluid dispenser as in claim 1 wherein said pressure-vent member further including a chamber portion disposed between a flange portion and a plug portion, said cavity being formed though said chamber and plug portions.

* * * * *